US006339975B1

(12) United States Patent
Harpell

(10) Patent No.: US 6,339,975 B1
(45) Date of Patent: Jan. 22, 2002

(54) ROOFING TOOL

(76) Inventor: William Harpell, 2380 Findlay Road, Joyceville, Ontario (CA), K0H 1Y0

( * ) Notice: Subject to any disclaimer, the term of this patent is extended or adjusted under 35 U.S.C. 154(b) by 0 days.

(21) Appl. No.: 09/585,789

(22) Filed: Jun. 5, 2000

Related U.S. Application Data

(63) Continuation-in-part of application No. 09/166,533, filed on Oct. 6, 1998, now abandoned, which is a continuation-in-part of application No. 08/728,162, filed on Oct. 9, 1996, now Pat. No. 5,836,222.

(51) Int. Cl.[7] ..... E04D 15/02
(52) U.S. Cl. ..... 81/45; 254/131.5
(58) Field of Search ..... 81/45, 46; 30/169, 30/172; 254/18, 21, 25, 131, 131.5; D8/88, 89; 299/37.5, 36.1

(56) References Cited

U.S. PATENT DOCUMENTS 1,211,655 A * 1/1917 Adams et al. ..... 294/49
2,594,598 A * 4/1952 Timmins ..... 294/49

* cited by examiner

*Primary Examiner*—D. S. Meislin

(57) ABSTRACT

A roofing tool having a blade of generally quadratic shape with a front edge, a rear edge, and side edges joining the front and rear edges. The tool has two teeth extending forwardly from the front edge of the blade, at least the front ends of the teeth adapted to be easily slipped under roofing shingles. The inner sides of the teeth are beveled allowing the teeth to slip under the heads of shingle nails to be able to lift them. A nail receiving slot is provided in the blade between the teeth extending rearwardly from the front edge of the blade. This slot can be used to lift shingle or framing nails. At least the front ends of the teeth can be spaced apart a distance greater than the width of roof framing members so the teeth can straddle the framing member and the teeth can be used to lever sheathing boards up from the framing member.

20 Claims, 6 Drawing Sheets

ROOFING TOOL

This application is a continuation-in-part application of U.S. patent application Ser. No. 09/166,533, filed Oct. 6, 1998, now abandoned, which application was a continuation-in-part application of U.S. patent application Ser. No. 08/728,162 filed Oct. 9, 1996, now issued as U.S. Pat. No. 5,836,222 on Nov. 17, 1998.

BACKGROUND OF THE INVENTION

1. Field of the Invention

This invention is directed toward a roofing tool. The invention is more particularly directed toward a bladed roofing tool with projecting teeth to be used in repairing or demolishing a roof including removing roofing materials such as shingles and sheathing boards.

2. Description of the Related Art Including Information Disclosed Under CFR §§1.97–1.99

Many bladed roofing tools are known. Most of these known tools have a blade, for use in prying or lifting up shingles, and nail receiving slots in the front edge of the blade for use in removing shingle nails left in the roof as the shingles are removed. Examples of such tools are shown in U.S. Pat. Nos. 4,086,699 and 5,280,676 by way of example. However a great deal of energy must still be expended in removing the roofing material and nails since the wide blades are difficult to drive under the shingles. Further, the known bladed tools are not well suited for lifting large pieces of material such as roof sheathing boards, used to support the shingles, when repairing or demolishing a roof. The known tools have difficulty in getting between the boards and the framing members which support them, and it is difficult to obtain the necessary leverage to lift the boards. Also, the tools are not particularly suited for easily lifting framing nails, which nails often remain in the roof when the sheathing boards are removed. The framing nails usually become securely embedded in the wood after a period of time and the slots in the known tools for receiving shingle nails are not deep enough to provide sufficient leverage to easily lift the framing nails. Often, closely adjacent shingle nails remain in the roof when the shingles are lifted and the known tools usually are not able easily to lift two or more of such nails simultaneously. It is time consuming to remove these closely adjacent nails one at a time.

SUMMARY OF THE INVENTION

It is the purpose of the present invention to provide an improved tool that is able, from its construction, to more easily be inserted under roofing material. It is another purpose of the present invention to provide a roofing tool that is able to provide more leverage to lift both small pieces of roofing material, such as shingles and shingle nails, and also larger pieces of roofing material such as sheathing boards, and also the larger framing nails associated with such boards and the framing members supporting such boards. It is another purpose of the present invention to provide roofing tools which can more easily simultaneously lift two or more shingle nails from a roof, particularly closely adjacent shingle nails, when removing shingles.

In accordance with one form of the present invention, a roofing tool is provided with a flat blade having a front edge and a rear edge. At least one nail receiving slot is provided in the front edge of the blade for use in removing shingle nails left in the roof as shingles and/or sheathing boards are removed and for removing framing nails as sheathing boards are removed. The bladed tool includes two teeth projecting forwardly from the front edge of the blade, one on either side of the nail receiving slot or slots, at least the front ends of the teeth adapted to easily slide under roofing material. The inner sides of the teeth are beveled to allow the inner sides of the teeth to also lift shingle nails.

The front ends of the teeth can be pushed under shingles on a roof and the blade is then levered up about the front ends of the teeth, or about the rear edge of the blade, to help remove the shingles. Any shingle nails left in the roof after the shingles are removed can be removed with the nail slot or slots and/or with the beveled inner sides of the teeth. The slots alone or in combination with the beveled inner sides of the teeth can be used to remove two shingle nails simultaneously. If any framing nails are encountered they can also be removed with a nail slot.

The front ends of the teeth are preferably spaced apart a distance greater than the normal width of roof framing members which members support roofing material such as sheathing boards, tin sections, etc. This allows the teeth to straddle a framing member with the teeth located under a sheathing board. Levering the teeth up by pivoting the blade about the back edge of the blade, while the back edge is on the framing member, will raise the sheathing board off the framing member.

The front ends of the two teeth are preferably pointed. This allows the front ends of the teeth to be easily inserted under shingles on the sheathing boards. The pointed front ends of the teeth, being spaced apart, also allow the tool to more easily straddle a framing member.

In one embodiment of the invention, the two teeth extend forward from the sides of the front edge of the blade. The two teeth are relatively narrow, straight sided, spaced apart, and parallel. The teeth are pointed just at the front end. At least one, and preferably several, nail receiving slots are provided in the front edge of the blade between the teeth.

In another embodiment of the invention, the teeth extend from nearly the entire length of the front edge and each tooth tapers to a point, the points spaced apart.

The blade, with the projecting teeth, makes it easier to lever up any nails, particularly framing nails, remaining in the roof. The teeth project forwardly from the front edge of the blade. The nail receiving slots project rearwardly from the front edge of the blade. This construction increases the lever arm for pulling up the nails when the nails are in the ends of the slots and the blade Is pivoted up about the pointed ends of the projecting teeth.

The invention is particularly directed toward a roofing tool having a generally quadratic blade with a front edge, a rear edge, and side edges joining the front and rear edges. A tubular socket for a handle extends upwardly and rearwardly from the top of the blade near its rear edge. The blade has two integral teeth projecting forwardly from the front edge of the blade, the forward ends of the teeth adapted to be easily slipped under roofing material to be removed. At least one nail receiving slot is provided in the blade between the teeth, the slot extending rearwardly from the front edge of the blade, so that a nail located in the end of the slot is located a considerable distance from the front of the teeth to provide a relatively long lever arm for lifting the nail. At least the inner sides of the teeth are beveled to allow the teeth to lift up shingle nails.

In a preferred embodiment the ends of the teeth are spaced a distance apart sufficient to allow at least a portion of the teeth to straddle a wood framing member, the teeth adapted to be manipulated to help loosen a sheathing board from a roof framing member.

DESCRIPTION OF THE PREFERRED EMBODIMENTS

Figure 1:
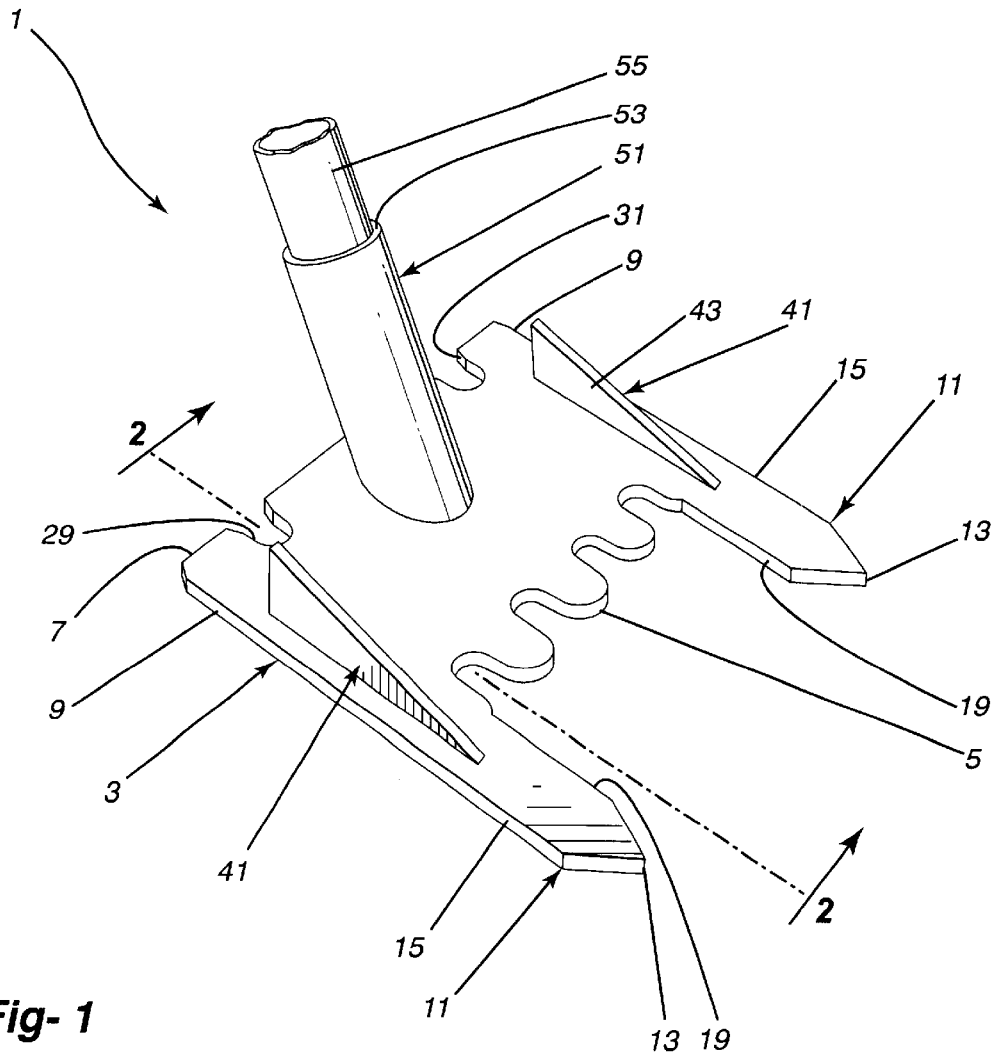
FIG. 1 is a perspective view of one embodiment of the roofing tool.
Figure 2:
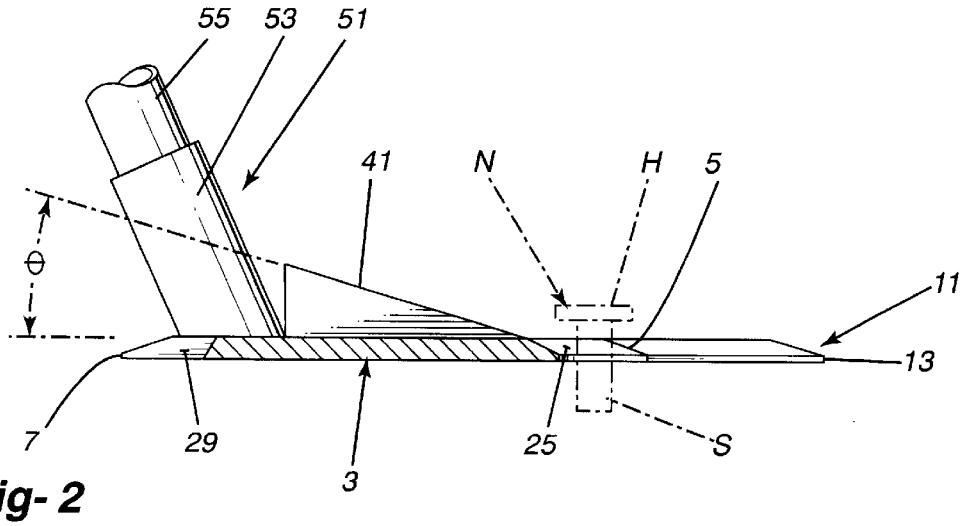
FIG. 2 is a cross-section view taken along line 2—2 in FIG. 1.

The roofing tool 1 shown in FIGS. 1 to 4 has a flat metal blade 3 with a generally quadratic or rectangular shape. The blade 3 has a front edge 5, a rear edge 7 and side edges 9, preferably parallel, joining the front and rear edges 5, 7.

The blade 3 also has a pair of spaced-apart, relatively narrow, teeth 11 extending forwardly from the front edge 5, the teeth in the same plane as the blade. The front ends of the teeth 11 are pointed as shown at 13. The outer sides 15 of the teeth form continuations of the side edges 9 of the blade 3 and are generally aligned with them. The teeth 11 can range in length from about one half inch to about six inches but are generally in the longer length range. The top of each tooth 11, at the pointed front end 13 and adjacent the sides 15, 19, is preferably tapered or beveled as shown at 21 in FIG. 3.

Figure 3:
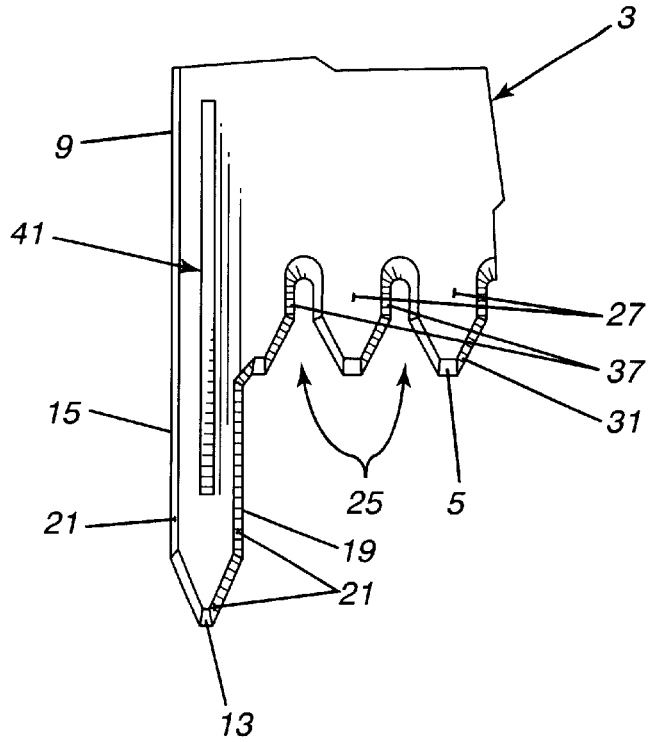
FIG. 3 is a detail plan view.

At least one nail receiving slot 25 extends inwardly or rearwardly from the front edge 5 between the teeth 11. Preferably, a plurality of nail slots 25 are provided in the front edge 5 forming short parallel fingers 27. At least one nail slot 29 also extends forwardly from the rear edge 7 of the blade 3. The mouths of the slots 25, 29 are widened as shown at 31 to provide easier entry into the slots. The top surface of each finger 27 is tapered or beveled adjacent the front and sides of the finger as shown at 37. The slots 25, 29 are sized to receive the shank S of a roofing or shingle nail N but will not pass the head H of the nail N as shown in FIGS. 1 and 3. The slots will also receive the shank of a framing nail, not shown, which nail is usually quite a bit longer than the roofing nail, but will not pass the head of the framing nail.

A camming plate 41 can be provided on each tooth 11, the plate 41 centrally located on the tooth and extending rearwardly partly onto the blade 3. The plate 41 is triangular in shape and is vertical on the horizontal blade 3. The plate 41 has a camming top edge 43 that slopes upwardly from the front at a shallow angle Φ. The angle Φ can range between ten degrees and twenty degrees and is preferably around fifteen degrees.

Handle attachment means 51 are provided on the blade 3. The handle attachment means comprise a short tubular member 53 fastened to the top of the blade 3 near its rear edge 7 and centrally located on the blade. The tubular member 53 slopes rearwardly and upwardly and receives a handle 55 for the tool.

Figure 4:
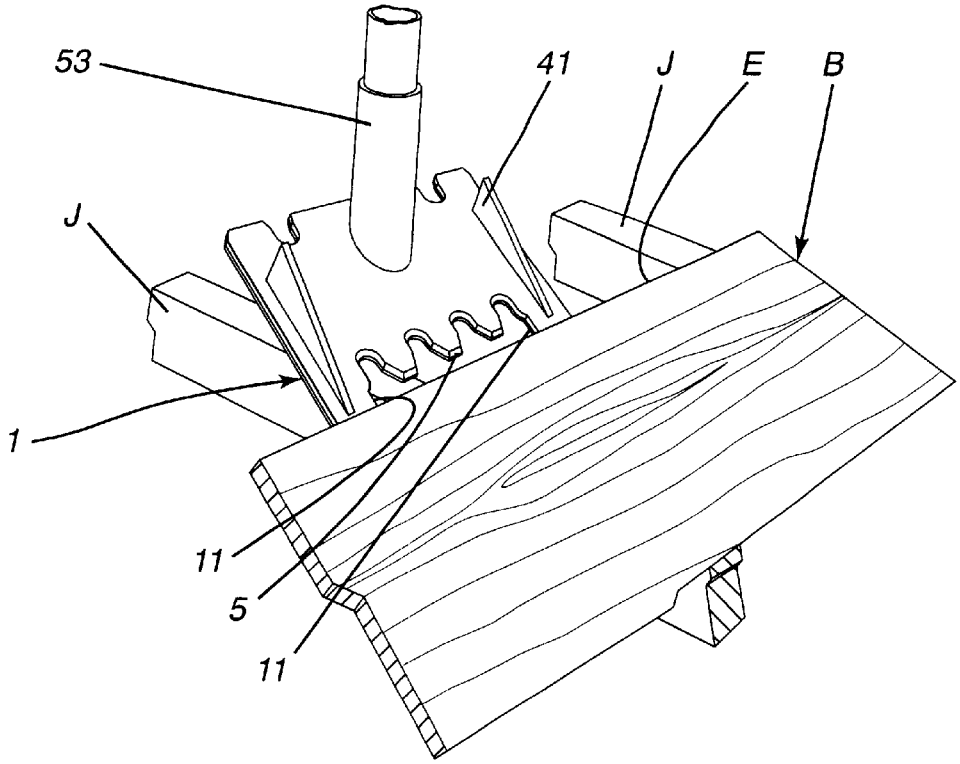
FIG. 4 is a perspective view showing the tool in use.
Figure 5A:
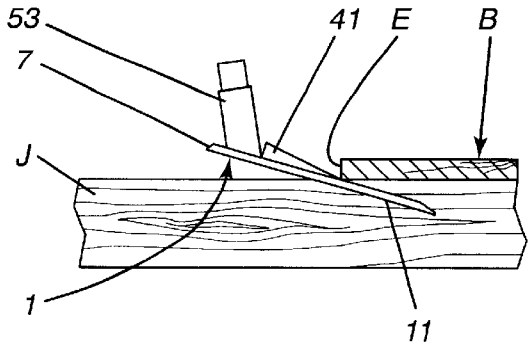
FIGS. 5A to 5C are side views showing the tool in use.
Figure 5B:
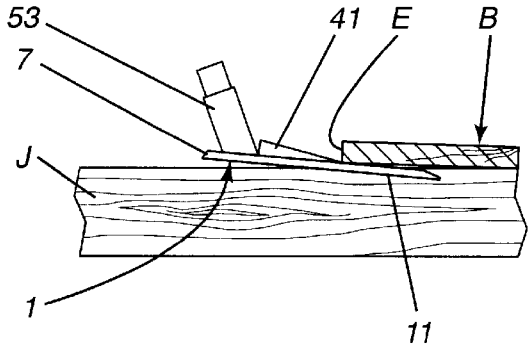
Figure 5C:
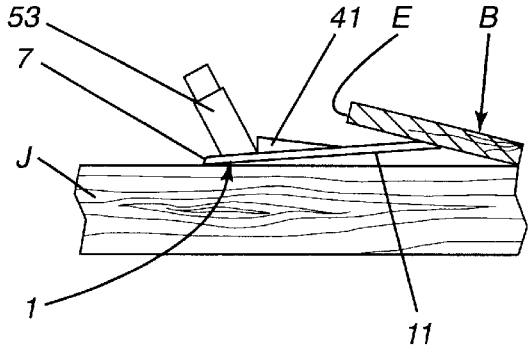

The tool 1 is particularly adapted to remove roofing material such as sheathing boards B nailed to rafters or joists J. The tool can be placed adjacent the edge E of the board B, the tool straddling the joist J the board B is fastened to with the teeth 11 extending under the board, one on either side of the joist J as shown in FIGS. 4 and 5A. The tool 1 can be pivoted about its front edge 5 to place the teeth 11, and the camming plates 41 on the teeth, if used, snug against the bottom of the board B as shown in FIG. 5B. Continued pivoting of the tool 1 will cause it to pivot about its rear edge 7 as shown in FIG. 5C to lever the board B up from the joist J by the front ends of the teeth 11.

The tool 1 can also be used to remove shingles or similar roofing material by easily sliding the pointed ends 13, of the teeth 11 under the shingles. The cam plates 41, if used, start to lever the shingles up and then the blade 3 can be pivoted about the tips 13 of the teeth 11 to further lever the shingles up. The long teeth 11 increase the lever arm of the blade making it easier to lift the shingles.

Figure 6:
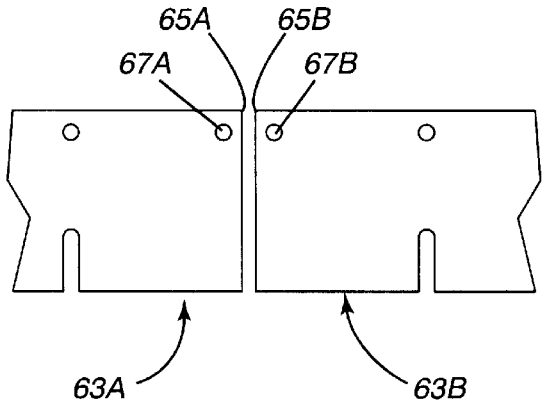
FIG. 6 is a plan view of a normal roof shingle arrangement.

The tool 1 can also be used to remove individual shingle nails. The individual shingle nails can be removed by using the slots 25, 29 or by using the beveled sides of the teeth 11. The inner beveled side of a tooth 11 can be slipped under the head of a shingle nail and the tooth can be levered up about the tip of the tooth to lift the nail. The tool can be also be used to remove at least two shingle nails simultaneously. When shingles are applied to a roof, adjacent shingles 63A, 63B, in the same layer of shingles as shown in FIG. 6, have adjacent corners 65A, 65B. A roofing nail 67A, 67B is driven into each adjacent corner 65A, 65B as shown and thus the nails in these corners are adjacent as well. The tool can easily lift both adjacent corner nails 67A, 67B simultaneously by locating the nails in the slots 25 or by locating one nail in a slot 25 and another nail adjacent a beveled side of a tooth 11. These adjacent nails may not always align up with 25 slots in the tool. However, since the fingers 27 are pointed, the nail shanks will slide at least part way into the slots. Having the fingers 27 beveled or tapered on the front and sides will allow the fingers to slide under the heads of the nails and allow them to be levered up even if they do not reach the end of the slots.

The tool 1 can also be used to lift framing nails such as those used to fasten sheathing boards to framing members. These nails are longer and often more securely held in the framing members. The tool is positioned to have the framing nail enter one of the slots 25 and the tool can be levered up against either the front of the projecting teeth 11 on the blade or the rear edge 7 of the blade. In either case, a long leverage arm makes it easier to withdraw the longer framing nails. Thus it is seen that the tool 1 is easily used both in shingling, to remove shingles and the associated shingle nails, and in demolition or renovation to remove roofing boards and the associated framing nails.

Figure 7:
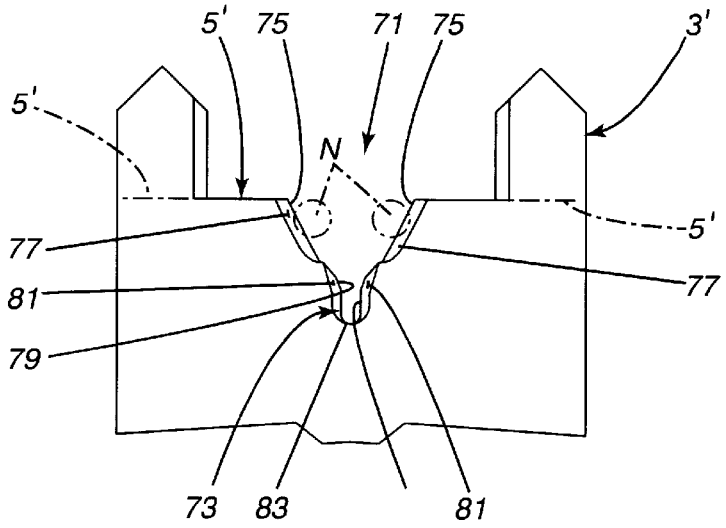
FIG. 7 is a plan view of a variation of the tool shown in FIG. 1.

The blade 3' of the tool of FIG. 1 can be modified to have a wider central slot 71 formed in the center of its front edge 5' as shown in FIG. 7. The wide central slot 71 is centrally located in the front edge 51 of the blade and has a width at the front edge 5' slightly wider than the normal spacing between adjacent corner shingle hails N in adjacent corners of adjacent shingles. The wide slot 71 tapers down toward a single narrow slot 73 similar to the slots 25 in tool 1. Although not shown, additional slots 73, similar to slots 25, could be provided on either side of the wide slot 71 as well.

The side edges 75 defining the wide slot 71 are preferably beveled as shown by the surfaces 77 as are the sides 79 of the narrow slot 73 as shown by the surfaces 81. The wide slot 71 allows a framing nail to be directed into the bottom or closed end 83 of the narrow slot 81 which bottom 83 is located farther away from the front edge 51 of the blade than the bottoms of the slots 25 in blade 3. This allows more leverage about the front edge 5' of the blade to more easily lift the framing nail from a frame member straddled by the tool. The wide entrance to the wide slot 71 also allows the tool to pick up two adjacent corner shingle nails N on the beveled side edges 75 allowing them to be lifted simultaneously,.

Figure 8:
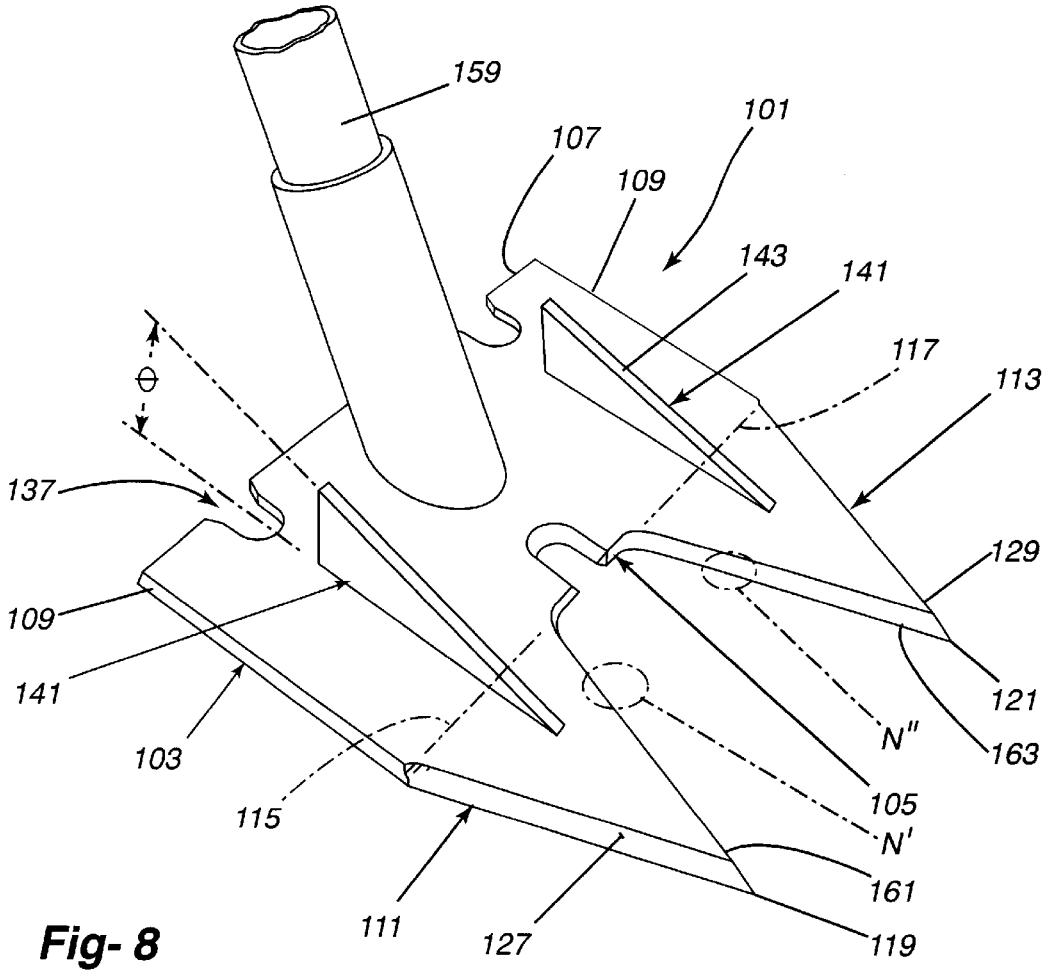
FIG. 8 is a perspective view of another embodiment of the roofing tool.
Figure 9:
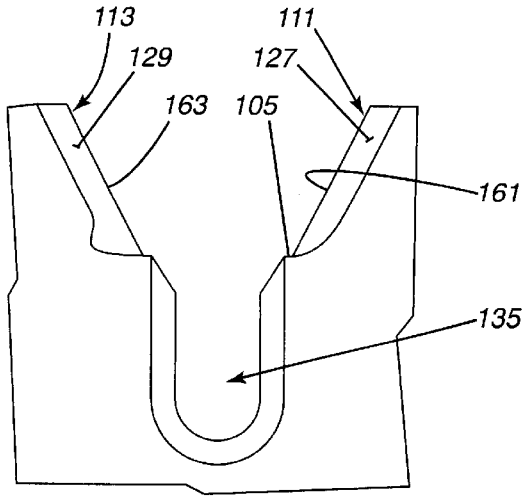
FIG. 9 is a detail plan view of the tool shown in FIG. 8.
Figure 10:
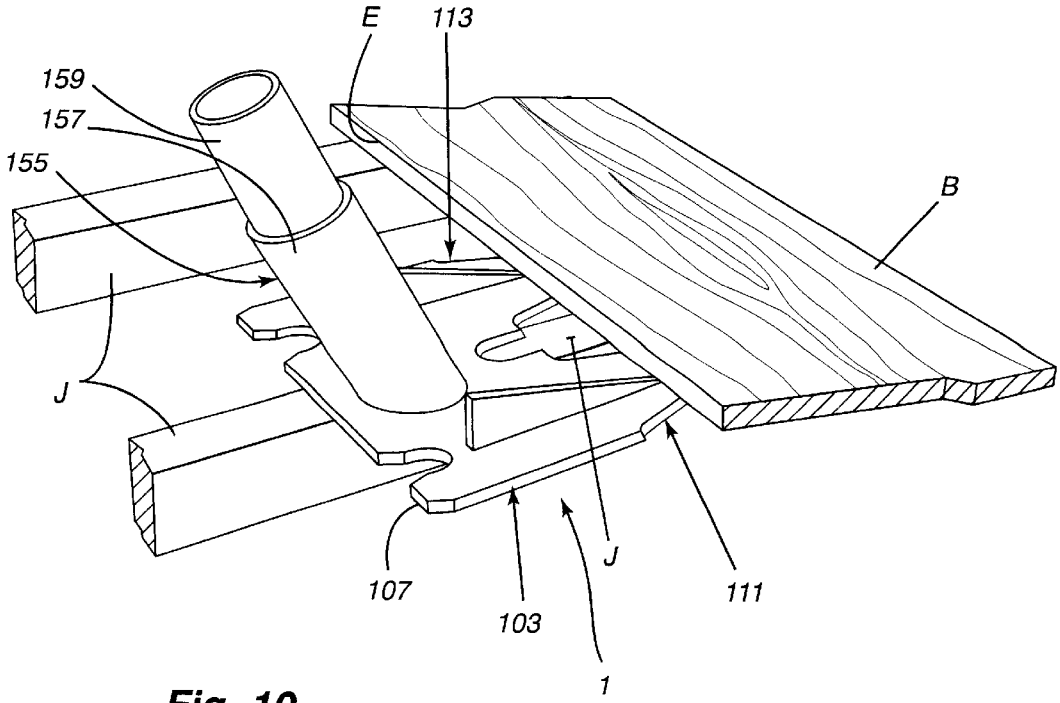
FIG. 10 is a perspective view of the tool in FIG. 8 in use.

In another embodiment of the invention as shown in FIGS. 8 to 10, the tool 101 has a flat, metal blade 103 with a generally quadratic or rectangular shape with a front edge 105, a rear edge 107 and side edges 109 which preferably are parallel. The blade 103 has two large front teeth 111, 113 that extend forwardly from the front edge 105, the teeth 111, 113, the teeth in the same plane as the blade 103. The bases 115, 117 of the teeth extend nearly across the front edge 105 with a narrow, central space between them. The teeth 111, 113 taper from their bases 115, 117 to a point 119, 121 with the points 119, 121 spaced a considerable distance apart. The tops of the teeth 111, 113 adjacent at least their inner sides can be tapered or beveled as shown at 127, 129. A nail receiving slot 135 extends rearwardly from the front edge 105 of the blade between the teeth 111, 113. One of more nail receiving slots 137 can be provided in the rear edge 107 of the blade extending forwardly. The slots 135, 137 are similar to the slots 25, 29, widened at their mouth, and sized to receive the shank of a roofing nail or framing nail but unable to pass the head of the nail.

The blade 103 can have camming plates 141, one located centrally on each tooth 111, 113, the camming plates tapered toward the front and having a top camming edge 143 that angles up toward the back at a shallow angle ≥. The plates 141 extend from the teeth 111, 113 onto the top of the blade 103.

The blade 103 also has handle attachment means 155 in the form of a tubular member 157 that is near the back edge 107 and extends upwardly and rearwardly from the top of the blade. The tubular member 157 is centrally located on the blade and receives the handle 159 of the tool.

This tool is also adapted to remove building material such as sheathing boards. The tool can be placed to have the teeth 111, 113 straddle a joist J adjacent the edge E of the board B as shown in FIG. 9 and the blade 103 is pivoted on the joist, about the inner edge 161, 163 of the teeth, to place the front of the teeth adjacent the bottom of the board B. The blade 103 is then pivoted about its rear edge 107, which rests on the joist J, to lever the board up via the front ends of the teeth 111, 113.

The tool 101 is also useful in removing shingles, the blade manipulated to slide the pointed, beveled, ends 119, 121 of the teeth under the shingles to have the camming plates initially cam the shingles upwardly. The blade can then be pivoted up about the front ends of its teeth to lever the shingles upwardly The tool 101 can also be used to remove shingle or framing nails with the nail slots 135, 137. The front teeth 111, 113 can also be used to remove two shingle nails at once, if desired. As shown in FIG. 8. the inner edges 161, 163 of the tapered teeth 111, 113 can be jammed on the outside of the shanks of two adjacent nails, N', N", under their heads, because the sides are beveled. The blade can then be levered up about the points 119, 121 of the teeth 111, 113 to remove both nails N', N" simultaneously.

Figure 11:
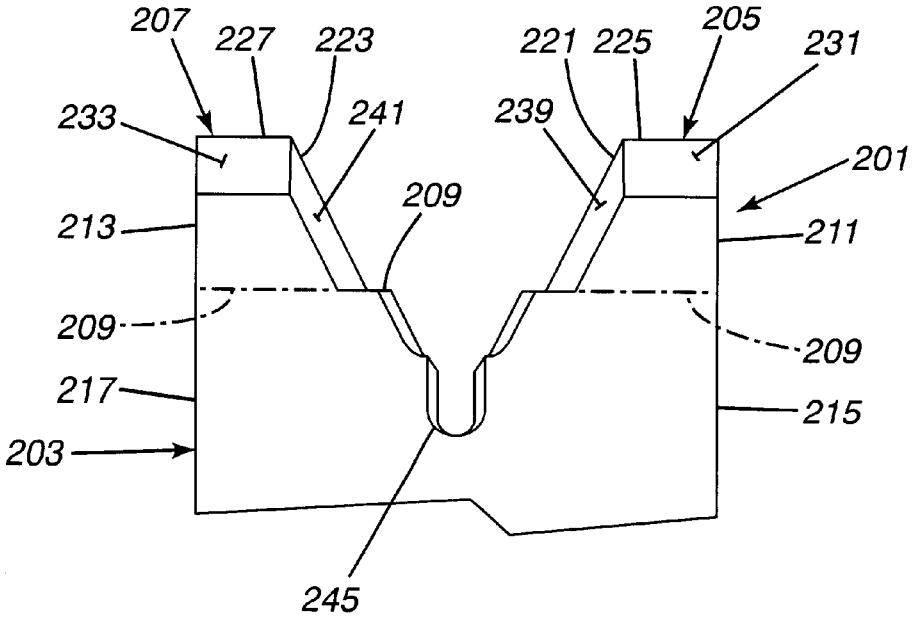
FIG. 11 is a plan view of another embodiment of the roofing tool.

In another embodiment of the invention, as shown in FIG. 11, the roofing tool 201 has a flat metal blade 203 with two truncated teeth 205, 207 extending forwardly from the front edge 209 of the blade 203. The outside edges 211, 213 of the teeth 205, 207 are preferably aligned with the sides 215, 217 of the blade. The inside edges 221, 223 of the teeth are angled toward each other. The front edges 225, 227 of the teeth 205, 207 are spaced wide enough apart to enable the teeth to receive a framing member, such as two by four, between them. This allows the tool to lever up sheathing boards when straddling framing members. The teeth in this embodiment are blunt with straight front edges 225, 227. However, the teeth 205, 207 are beveled back from the front edges 225, 227 as shown by beveled surfaces 231, 233 so that the teeth can be easily inserted under shingles and like roofing material.

The inner sides 221, 223 of the teeth 205, 207 are beveled as well as shown by surfaces 239, 241. A nail receiving slot 245 is provided in the front of the blade 203. The nail slot 245 is preferably centrally located in the blade and extends rearwardly from the front edge 209. The slot 245 can receive the shanks of either shingle nails or framing nails. The teeth 205, 207, extending forwardly from the front edge 209 of the blade, extend the leverage of the blade when it is tipped up about the front edges 225, 227 of the teeth to more easily lift up the nails caught in the slot 245.

Figure 12:
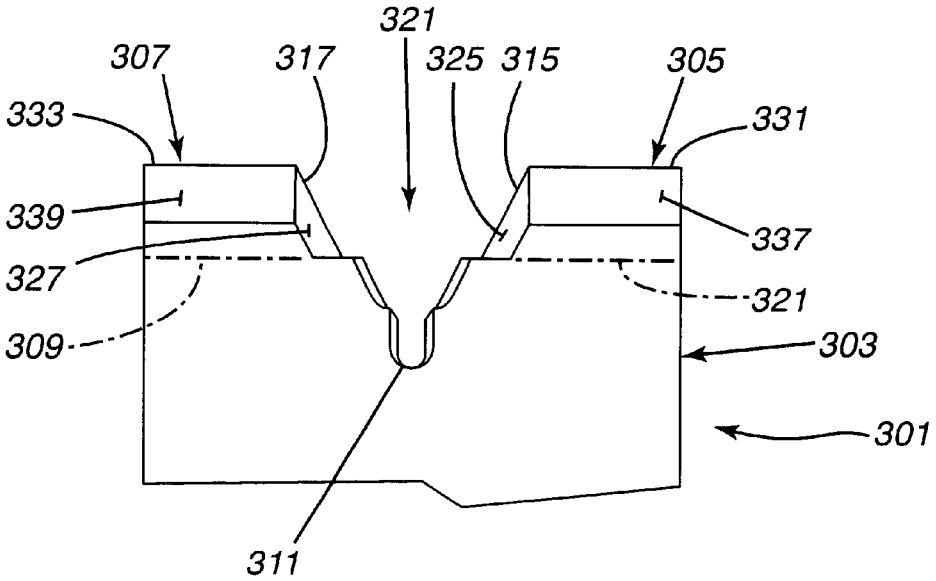
FIG. 12 is a plan view of a variation of the tool shown in FIG. 11.

In another embodiment of the invention, as shown in FIG. 12, the tool 301 can have a blade 303 with short, wide teeth 305, 307 extending forwardly from its front edge 309. A central nail receiving slot 311 extends inwardly from the front edge 309 of the blade 303. The inner sides 315, 317 of the teeth 305, 307 are angled toward each other and toward the mouth of the slot 311 and form a tapered entrance 321 to the slot 311. The inner sides 315, 317 of the teeth 305, 307 in this embodiment are just slightly wider at the mouth of the entrance 321 than the normal distance between adjacent corner roofing nails in adjacent corners of adjacent shingles. This allows the entrance 321 to receive closely adjacent shingle nails so as to be able to lift both simultaneously. The inner sides 315, 317 of the entrance 321 are beveled as shown by the surfaces 325, 327 to be able to slide under the heads of roofing nails. The wide, front edges 331, 333 of the teeth 3.05, 307, extending parallel to the front edge 309 of the blade, are also beveled rearwardly as shown by the surfaces 335, 337 to allow the teeth to more easily slip under roofing material.

The blades 3', 203 and 303 shown in FIGS. 7, 11 and 12 can also have a camming plate, similar to the camming plates 41 associated with blade 3, associated with each tooth.

The various tools have been described as roofing tools but they can also be used to remove material from other building surfaces such as floors, walls and ceilings. The tools can be used in removing material to repair the building or to demolish it.

I claim:

1. A roofing tool having a generally quadratic blade with a front edge, a rear edge, and side edges joining the front and rear edges; a tubular socket for a handle extending upwardly and rearwardly from the top of the blade near its rear edge; the blade having two integral teeth projecting forwardly from the front edge of the blade, the forward ends of the teeth adapted to be easily slipped under roofing material to be removed; at least one nail receiving slot provided in the blade between the teeth, the slot extending rearwardly from the front edge of the blade, so that a nail located in the end of the slot is located a considerable distance from the front of the teeth to provide a relatively long lever arm for lifting the nail; the slot having parallel sides spaced apart a distance to receive the shank of a nail between the sides while supporting the head of the nail on the blade adjacent the sides; and at least the inner sides of the teeth beveled to allow the teeth to lift up shingle nails.

2. A roofing tool as claimed in claim 1 wherein at least the forward ends of the teeth are pointed and spaced a distance apart sufficient to allow at least a portion of the teeth to straddle a roof framing member.

3. A roofing tool as claimed in claim 1 wherein the teeth extend from the front edge of the blade, adjacent the sides of the blade, the teeth parallel and spaced a distance apart sufficient to allow the teeth to straddle a roof framing member.

4. A roofing tool as claimed in claim 3 wherein the front ends of the teeth are pointed.

5. A roofing tool as claimed in claim 1 wherein the teeth are tapered to a point with the base of the teeth extending across a substantial portion of the front edge of the blade, the pointed front ends spaced a part a distance sufficient to allow the front portions of the teeth to straddle a roof framing member.

6. A roofing tool as claimed in claim 3 including a wide slot formed in the front edge of the blade, the slot extending rearwardly and tapering inwardly, the sides of the slot being beveled, the mouth of the slot having a width slightly greater than the distance between two adjacent corner shingle nails.

7. A roofing tool as claimed in claim 6 wherein the nail receiving slot is located in the bottom of the wide slot and extends rearwardly therefrom.

8. A roofing tool as claimed in claim 4 including a wide slot formed in the front edge of the blade, the slot extending rearwardly and tapering inwardly, the sides of the slot being beveled, the mouth of the slot having a width slightly greater than the distance between two adjacent corner shingle nails.

9. A roofing tool as claimed in claim 8 wherein the nail receiving slot is located in the bottom of the wide slot and extends rearwardly therefrom.

10. A roofing tool as claimed in claim 1 wherein the teeth have front edges that are relatively wide, straight and parallel to the front edge of the blade, the top of the teeth adjacent their front edges beveled toward the front edges; the front edges of the teeth spaced a distance apart sufficient to allow the teeth to straddle a roof framing member.

11. A roofing tool as claimed in claim 1 wherein the teeth have front edges that are relatively wide, straight and parallel to the front edge of the blade, the top of the teeth adjacent their front edges beveled toward the front edges; the teeth tapering from the front edge of the blade; the front edges of the teeth spaced a distance apart sufficient to allow at least a portion of the teeth to straddle a roof framing member.

12. A roofing tool as claimed in claim 1 wherein the teeth have front edges that are relatively wide, straight and parallel to the front edge of the blade, the top of the teeth adjacent their front edges beveled toward the front edges; the teeth tapering from the front edge of the blade; the front edges of the teeth spaced apart a distance slightly greater than the distance between two adjacent corner shingle nails.

13. A tool as claimed in claim 1 wherein a camming plate is mounted on the approximate center of each tooth, the camming plate extending rearwardly from the tooth onto the blade, the camming plate having a top camming edge that angles upwardly at a shallow angle toward the rear edge of the blade.

14. A tool as claimed in claim 4 wherein a camming plate is mounted on the approximate center of each tooth, the camming plate extending rearwardly from the tooth onto the blade, the camming plate having a top camming edge that angles upwardly at a shallow angle toward the rear edge of the blade.

15. A tool as claimed in claim 5 wherein a camming plate is mounted on the approximate center of each tooth, the camming plate extending rearwardly from the tooth onto the blade, the camming plate having a top camming edge that angles upwardly at a shallow angle toward the rear edge of the blade.

16. A tool as claimed in claim 8 wherein a camming plate is mounted on the approximate center of each tooth, the camming plate extending rearwardly from the tooth onto the blade, the camming plate having a top camming edge that angles upwardly at a shallow angle toward the rear edge of the blade.

17. A tool as claimed in claim 11 wherein a camming plate is mounted on the approximate center of each tooth, the camming plate extending rearwardly from the tooth onto the blade, the camming plate having a top camming edge that angles upwardly at a shallow angle toward the rear edge of the blade.

18. A tool as claimed in claim 12 wherein a camming plate is mounted on the approximate center of each tooth, the camming plate extending rearwardly from the tooth onto the blade, the camming plate having a top camming edge that angles upwardly at a shallow angle toward the rear edge of the blade.

19. A roofing tool as claimed in claim 1 wherein the teeth taper from the front edge of the blade to at least a distance from the front edge where the teeth are spaced apart a distance slightly greater than the distance between two adjacent corner shingle nails.

20. A roofing tool as claimed in claim 1 wherein at least a portion of the teeth are spaced apart a distance sufficient to allow the teeth to straddle a frame member.

* * * * *